US009221167B2

(12) United States Patent
Sun

(10) Patent No.: US 9,221,167 B2
(45) Date of Patent: Dec. 29, 2015

(54) SCREW BIT HOLDER

(71) Applicant: SHANGHAI EASY-USE TOOLS ENTERPRISE CO., LTD, Shanghai (CN)

(72) Inventor: Shiyu Sun, Shanghai (CN)

(73) Assignee: SHANGHAI EASY-USE TOOLS ENTERPRISE CO., LTD, Shanghai (CN)

( * ) Notice: Subject to any disclaimer, the term of this patent is extended or adjusted under 35 U.S.C. 154(b) by 244 days.

(21) Appl. No.: 14/002,684

(22) PCT Filed: Jan. 10, 2013

(86) PCT No.: PCT/CN2013/070303
§ 371 (c)(1),
(2) Date: Aug. 30, 2013

(87) PCT Pub. No.: WO2013/097833
PCT Pub. Date: Jul. 4, 2013

(65) Prior Publication Data

US 2014/0090521 A1 Apr. 3, 2014

(51) Int. Cl.
*B25G 1/08* (2006.01)

(52) U.S. Cl.
CPC ..... *B25G 1/085* (2013.01)

(58) Field of Classification Search
CPC ..... B25G 1/085; B25B 23/16
USPC ..... 81/177.4, 490, 492
See application file for complete search history.

(56) References Cited

U.S. PATENT DOCUMENTS

| | | | | |
|---|---|---|---|---|
| 5,265,504 | A * | 11/1993 | Fruhm | 81/439 |
| 5,613,413 | A * | 3/1997 | Huang | 81/490 |
| 5,873,648 | A * | 2/1999 | Shiao | 362/119 |
| 6,305,815 | B1 * | 10/2001 | Lin | 362/119 |
| 6,490,955 | B2 | 12/2002 | Chang-Kao et al. | |
| 6,508,156 | B1 * | 1/2003 | Wei | 81/490 |
| 6,510,768 | B2 * | 1/2003 | Fruhm | 81/490 |
| 6,968,760 | B2 * | 11/2005 | Hu | 81/490 |
| 7,039,975 | B1 * | 5/2006 | Liao | 7/165 |
| 7,281,455 | B2 * | 10/2007 | Hu | 81/177.4 |
| 7,305,908 | B2 * | 12/2007 | Chi | 81/177.4 |
| 7,395,739 | B1 * | 7/2008 | Chen | 81/177.4 |
| 7,698,972 | B2 * | 4/2010 | Hi | 81/177.8 |

(Continued)

FOREIGN PATENT DOCUMENTS

| | | |
|---|---|---|
| CN | 2877971 Y | 3/2007 |
| CN | 201579780 U | 9/2010 |

(Continued)

*Primary Examiner* — David B Thomas
(74) *Attorney, Agent, or Firm* — Muncy, Geissler, Olds & Lowe, P.C.

(57) ABSTRACT

A screw bit holder includes a handle. The handle has a chamber at an upper part thereof. The handle includes a first fixing rod fixed at a lower end thereof for mounting a screw bit. A fixing shaft is provided in the chamber of the handle for fixing a plurality of screw bits. The fixing shaft comprises a second fixing rod at one end thereof. The second fixing rod is adapted to fix the screw bit for timepiece. The screw bit holder further comprises a fixing disc. The fixing disc has a central through hole. The fixing disc is fitted on the outside of the fixing shaft through the through hole. The fixing disc has a plurality of fixing troughs around an outer side thereof. The screw bits are secured through the fixing troughs. The screw bits can be stored in the handle to prevent them from losing.

7 Claims, 7 Drawing Sheets

(56) References Cited

U.S. PATENT DOCUMENTS

| | | | | |
|---|---|---|---|---|
| 7,748,296 | B2 * | 7/2010 | Hu | 81/57.3 |
| 8,590,432 | B2 * | 11/2013 | Wang | 81/177.4 |
| 8,833,214 | B2 * | 9/2014 | Wang | 81/490 |
| 2003/0015071 | A1 * | 1/2003 | Liao | 81/177.9 |
| 2004/0025650 | A1 | 2/2004 | Hu | |
| 2006/0016301 | A1 * | 1/2006 | Huang | 81/489 |
| 2006/0016302 | A1 * | 1/2006 | Huang | 81/489 |
| 2009/0071299 | A1 * | 3/2009 | Lin | 81/177.4 |
| 2010/0288087 | A1 * | 11/2010 | Lai | 81/490 |

FOREIGN PATENT DOCUMENTS

| | | |
|---|---|---|
| CN | 202412157 U | 9/2012 |
| DE | 200 20 936 U1 | 4/2001 |

* cited by examiner

SCREW BIT HOLDER

BACKGROUND OF THE INVENTION

1. Field of the Invention

The present invention relates to a screw bit holder.

2. Description of the Prior Art

A conventional screw driving tool comprises a handle and a bit. The handle and the bit are one-piece and cannot be replaced with other bits. An improved screw driving tool comprises a handle and a plurality of screw bits. However, most of the screw bits are in one type and not adapted for different demands. Besides, they are separate. When not in use, it is easy to lose the screw bits.

SUMMARY OF THE INVENTION

The primary object of the present invention is to provide a screw bit holder to overcome the shortcomings of the prior art.

According to a first aspect of the present invention, the screw bit holder comprises a handle. The handle has a chamber at an upper part thereof. The handle comprises a first fixing rod fixed at a lower end thereof for mounting a screw bit. A fixing shaft is provided in the chamber of the handle for fixing a plurality of screw bits. The fixing shaft comprises a second fixing rod at one end thereof. The second fixing rod is adapted to fix the screw bit for timepiece. The screw bit holder further comprises a fixing disc. The fixing disc has a central through hole. The fixing disc is fitted on the outside of the fixing shaft through the through hole. The fixing disc has a plurality of fixing troughs around an outer side thereof. The screw bits are secured through the fixing troughs.

Preferably, the outside of the fixing shaft has a plurality of guide grooves, the fixing disc having a plurality of resilient members thereon. The resilient members protrude out of the through hole. The resilient members are buckled on the guide grooves.

Preferably, the fixing disc has a partition to divide each of the fixing troughs into two parts. The resilient members are disposed on upper and lower ends of the fixing disc. One end of each resilient member is fixed to the partition, and the other end of each resilient member protrudes out of the through hole.

Preferably, an upper end of the handle is movably connected with a base located at an upper end of the chamber to seal the chamber. A lower end surface of the base has a plurality of fixing troughs to accommodate the screw bits.

Preferably, the base comprises a plurality of engaging members thereon. An upper end of the wall of the chamber is provided with a plurality of protrusions to mate with the engaging members. The engaging members are buckled on the protrusions so that the base is buckled on the wall of the chamber. The base further comprises a plurality of press boards at outer sides of the engaging members. When the press boards are pressed, the press boards are deformable to press the engaging members to disengage from the protrusions. The handle has a notch corresponding in position to the press boards.

Preferably, the handle comprises a plurality of anti-skid protrusions and anti-skid grooves on an outer wall thereof.

According to a second aspect of the present invention, the screw bit holder comprises a handle. The handle has a chamber. The handle comprises a first fixing rod fixed at one end thereof for mounting a screw bit. A ratchet is connected between the handle and the first fixing rod. A fixing shaft is provided in the chamber of the handle for fixing a plurality of screw bits. One end of the fixing shaft is connected with a second fixing rod through the ratchet for mounting a screw bit for timepiece.

According to a third aspect of the present invention, the screw bit holder comprises a handle. The handle has a chamber. The handle comprises a first fixing rod fixed at one end thereof for mounting a screw bit. A fixing shaft is provided in the chamber of the handle for fixing a plurality of screw bits. One end of the fixing shaft is connected with a second fixing rod through a ratchet for mounting a screw bit for timepiece.

According to a third aspect of the present invention, the screw bit holder comprises a handle. The handle has a chamber. The handle comprises a first fixing rod fixed at one end thereof for mounting a screw bit. A ratchet is connected between the handle and the first fixing rod. A fixing shaft is provided in the chamber of the handle for fixing a plurality of screw bits. One end of the fixing shaft is connected with a second fixing rod for mounting a screw bit for timepiece.

According to the screw bit holder of the present invention, the plurality of screw bits can be accommodated and stored in the handle to prevent them from losing. The handle comprises a second handle for fixing timepiece screws to satisfy the user for different demands.

DETAILED DESCRIPTION OF THE PREFERRED EMBODIMENTS

Embodiments of the present invention will now be described, by way of example only, with reference to the accompanying drawings.

Figure 1:
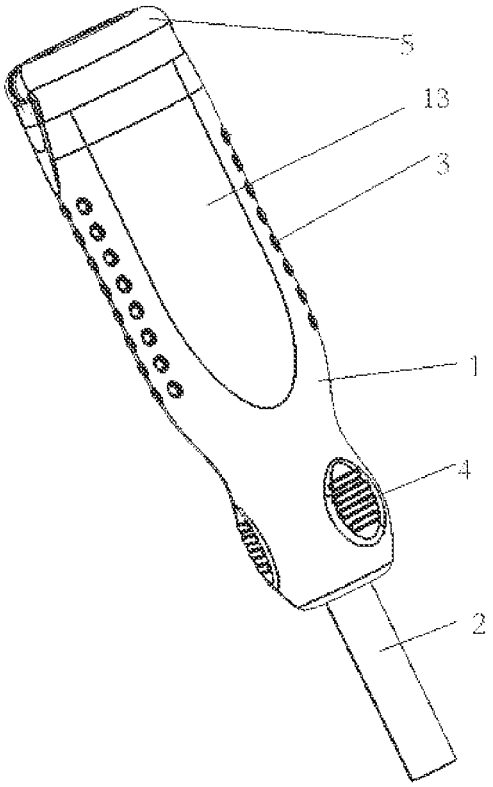
FIG. 1 is a perspective view showing the screw bit holder according to a first embodiment of the present invention.
Figure 2:
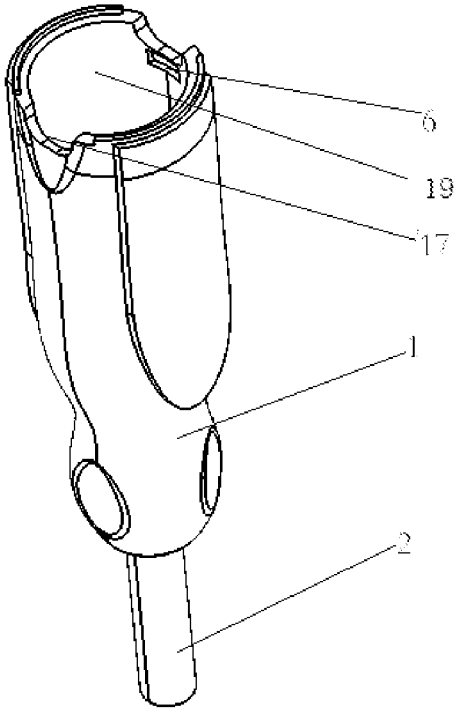
FIG. 2 is a perspective view of FIG. 1 showing that the base of the screw bit holder is removed.

As shown in FIG. 1 to FIG. 2, the screw bit holder according to a first embodiment of the present invention comprises a handle 1. The handle 1 has a chamber 19 at an upper part thereof. The handle 1 comprises a first fixing rod 2 at a lower end thereof. The first fixing rod 2 is adapted to fix a screw bit 9. A fixing shaft 7 is provided in the chamber of the handle 1.

Figure 4:
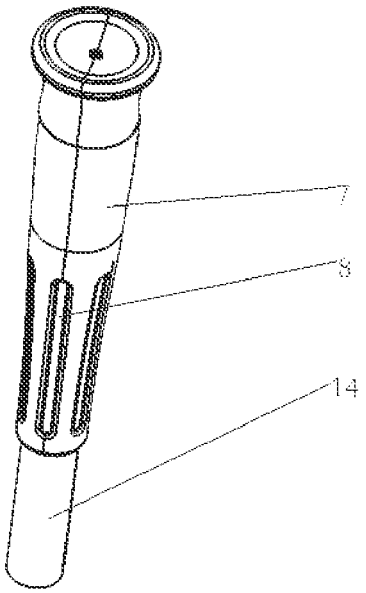
FIG. 4 is a schematic view showing the fixing shaft of FIG. 3.
Figure 5:
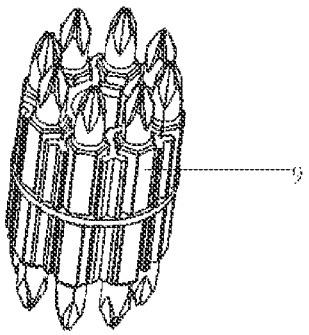
FIG. 5 is a schematic view showing the fixing disc and the screw bits of FIG. 3.

The fixing shaft 7 can be used as a screwdriver handle. FIG. 4 is a perspective view of the fixing shaft of the present invention. The fixing shaft 7 comprises a second fixing rod 14 at one end thereof. The second fixing rod 14 is adapted to fix the screw bit 9. The screw bit 9 is secured to the second fixing rod 14. The fixing shaft 7 can be used as the handle. In this embodiment, the screw bit secured by the second fixing rod 14 is a screw bit for timepiece.

Figure 3:
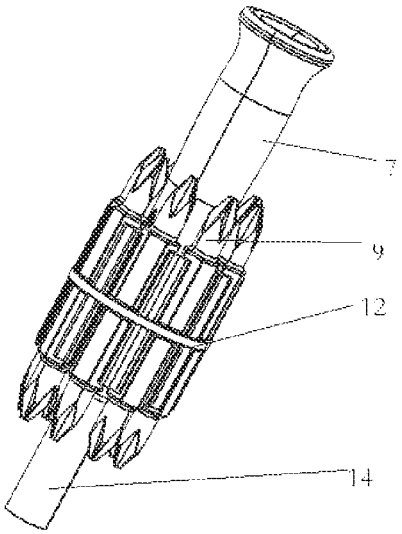
FIG. 3 is a perspective view of FIG. 1 showing that the handle and the base of the screw bit holder is removed.

As shown in FIG. 3, the screw bit holder further comprises a fixing disc 12. The fixing disc 12 has a central through hole 12. The fixing disc 12 is fitted on the outside of the fixing shaft 7 through the through hole 122. The fixing disc 12 has a plurality of fixing troughs 123 around an outer side thereof. The screw bits are secured through the fixing troughs 123. In this embodiment, the screw bits secured by the fixing troughs 123 are screw bits for timepiece.

Figure 9:
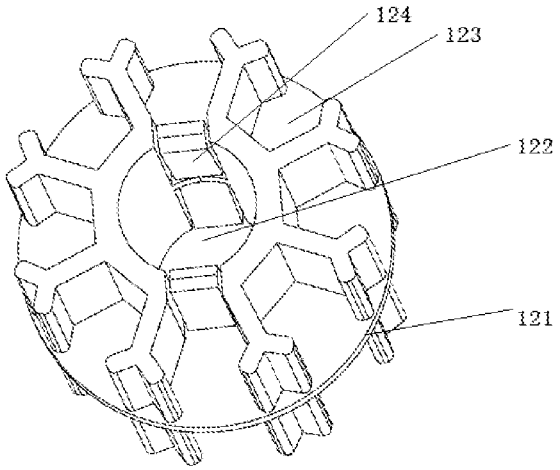
FIG. 9 is a schematic view showing the fixing disc of FIG. 1.

The outside of the fixing shaft 7 has a plurality of guide grooves 8, as shown in FIG. 4. The fixing disc 12 has a plurality of resilient members 124 thereon. The resilient members 124 protrude out of the through hole. As shown in FIG. 9, the resilient members 124 are buckled on the guide grooves 8. FIG. 3 is a schematic view to show that the fixing disc 12 of the present invention is fitted on the fixing shaft 7. The fixing disc 12 has the plurality of fixing troughs. The screw bits 9 are secured through the fixing troughs. This can prevent the fixing disc from turning and confine the fixing disc 12.

FIG. 9 is a schematic view showing the fixing disc of the present invention. The fixing disc has a partition 121 to divide each of the fixing troughs into two parts. The resilient members 121 are disposed on upper and lower ends of the fixing disc. One end of each resilient member 124 is fixed to the partition, and the other end of each resilient member 124 protrudes out of the through hole.

Figure 6:
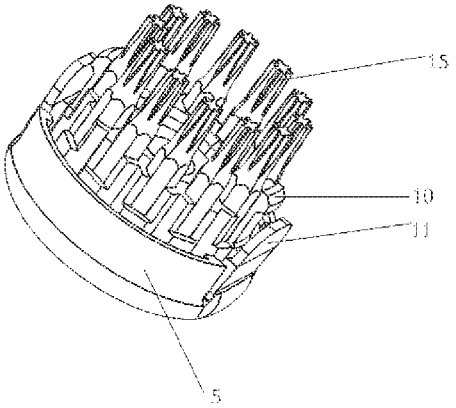
FIG. 6 is a schematic view showing the base of FIG. 1 and the screw bits.
Figure 7:
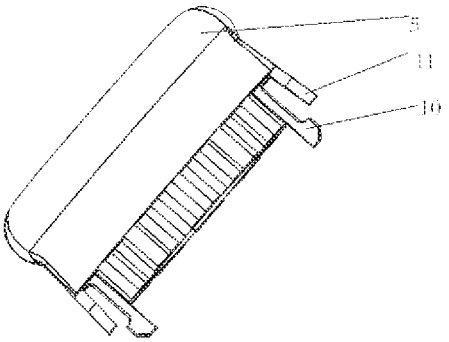
FIG. 7 is a schematic view showing the base of FIG. 6.
Figure 8:
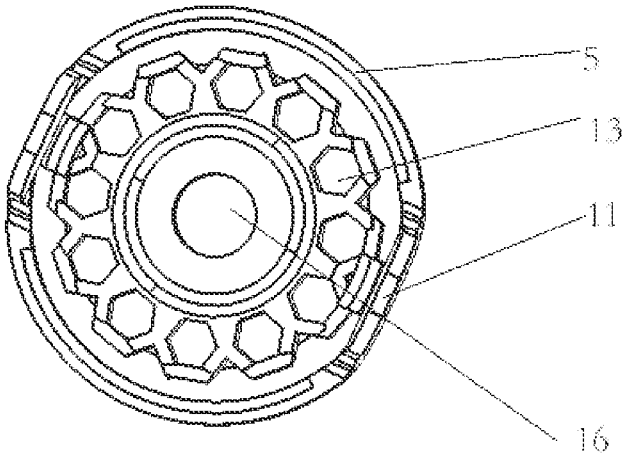
FIG. 8 is a front view of FIG. 7.

As shown in FIG. 6 to FIG. 8, the other end of the handle 1 is movably connected with a base 5. FIG. 6 to FIG. 8 is to show the configuration of the base. The base 5 comprises a plurality of engaging members 10 thereon. The upper end of the wall of the chamber is provided with a plurality of protrusions 6 to mate with the engaging members. The engaging members 10 are buckled on the protrusions 6 so that the base 5 is buckled on the wall of the chamber. The base 5 further comprises a plurality of press boards 11 at the outer sides of the engaging members 10. When the press boards 11 are pressed, the press boards 11 are deformable to press the engaging members 10 to disengage from the protrusions 6. The handle has a notch 17 corresponding in position to the press boards.

In this embodiment, the engaging member 10 is an L-shaped engaging member. The base 5 is fixed to the handle 1. The engaging members 10 are secured on the protrusions 6 provided on the inner side of the handle 1. When the user wants to fetch a screw bit 9 inside the handle, the engaging member 10 is pressed to disengage from the protrusion 6 so as to take off the base 5. The press board 11 is disposed beside the engaging member 10. The handle 1 has the notch 17. The press board 11 is pressed to pass the notch 17 and press the engaging member 10 to disengage from the corresponding protrusion so that the fixing shaft and the fixing disc can be taken out. When the user wants to take out the fixing shaft or screw bits inside the handle, the press board is pressed to press the engaging member to disengage from the corresponding protrusion so as to take off the base. After taking out a desired bit, the press board is pressed to press the engaging member, and then the base is fitted to the handle. After that, the press board is released and the engaging member restores to its original state to engage with the protrusion, such that the base is secured to the handle firmly. The press board is located at the outer side of the engaging member, providing a protection function to the engaging member and preventing the engaging member from being damaged by an external force. By pressing the press board to press the engaging member and then to take off the base, the press board has a torque to apply a force to the engaging member so it is labor-saving. Through cooperation of the press board and the engaging member, the engaging member gets less press strength so it has a longer service life and won't be damaged easily. The base can be secured to or taken off from the handle by one touch. Compared to the thread connection, this way saves time.

The handle 1 comprises a plurality of anti-skid protrusions 3 and anti-skid grooves 4 on an outer wall thereof. The anti-skid protrusions 3 and the anti-skid grooves 4 are adapted to prevent the user's hand from skidding when in use.

The chamber of the handle of the screw bit holder of the present invention can accommodate a plurality of screw bits. When in use, a desired screw bit 9 is taken out to be secured to the first fixing rod 2 at the end of the handle. The anti-skid protrusions 3 and the anti-skid grooves 4 on the handle 1 prevent the user's fingers from skidding when applying a force. The handle 1 further has a window 13 for the user to see and choose the screw bits inside the handle conveniently.

Figure 10:
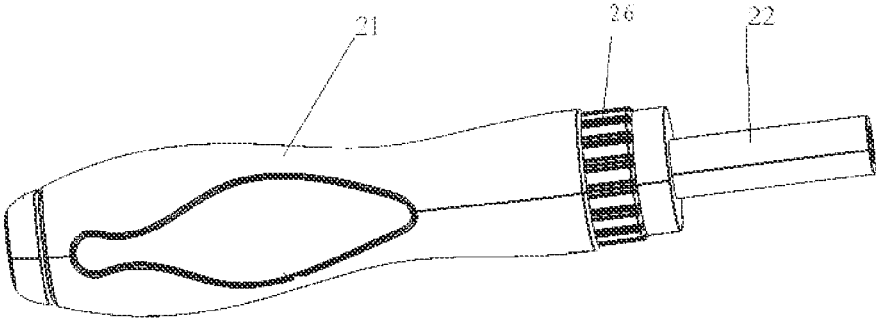
FIG. 10 is a perspective view according to a second embodiment of the present invention.
Figure 11:
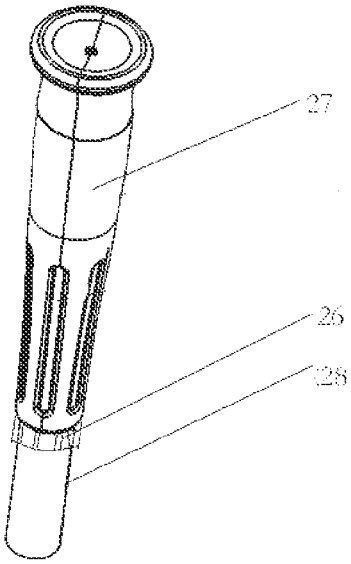
FIG. 11 is a schematic view showing the fixing shaft of FIG. 10.

FIG. 10 and FIG. 11 show a second embodiment of the present invention. FIG. 10 is a schematic view showing the screw bit holder according to the second embodiment of the present invention. The screw bit holder comprises a handle 21. The handle 21 has a chamber. The handle 21 comprises a first fixing rod 22 fixed at one end thereof for mounting a screw bit. A ratchet 26 is connected between the handle 21 and the first fixing rod 22. A fixing shaft 27 is provided in the chamber of the handle 21. The fixing shaft 27 is adapted to fix a plurality of screw bits. FIG. 11 is a schematic view showing the fixing shaft of FIG. 10. One end of the fixing shaft 27 is connected with a second fixing rod 28 through the ratchet 26 for mounting a screw bit for timepiece.

The screw bit holder further comprises a fixing disc. The fixing disc has a central through hole. The fixing disc is fitted on the outside of the fixing shaft through the through hole. The fixing disc has a plurality of fixing troughs around an outer side thereof. The screw bits are secured through the fixing troughs. The outside of the fixing shaft has a plurality of guide grooves. The fixing disc has a plurality of resilient members thereon. The resilient members protrude out of the through hole. The resilient members are buckled on the guide grooves. The fixing disc has a partition to divide each of the fixing trough into two parts. The resilient members are disposed on upper and lower ends of the fixing disc. One end of each resilient member is fixed to the partition, and the other end of each resilient member protrudes out of the through hole. Through the ratchet, the present invention is used conveniently to save labor greatly.

Figure 12:
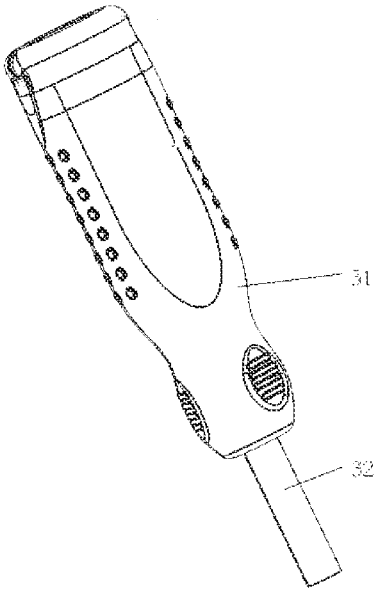
FIG. 12 is a perspective view according to a third embodiment of the present invention.
Figure 13:
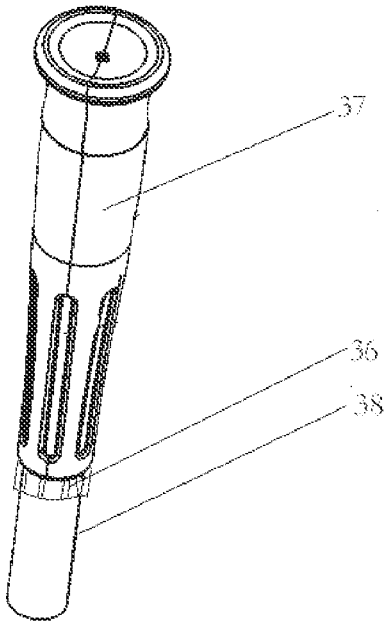
FIG. 13 is a schematic view showing the fixing shaft of FIG. 12.

FIG. 12 and FIG. 13 show a third embodiment of the present invention. FIG. 12 is a schematic view showing the screw bit holder according to the third embodiment of the present invention. The screw bit holder comprises a handle 31. The handle 31 has a chamber. The handle 31 comprises a first fixing rod 32 fixed at one end thereof for mounting a screw bit. A fixing shaft 37 is provided in the chamber of the handle 31. The fixing shaft 37 is adapted to fix a plurality of screw bits. FIG. 13 is a schematic view showing the fixing shaft of FIG. 12. One end of the fixing shaft 37 is connected with a second fixing rod 38 through the ratchet 36 for mounting a screw bit for timepiece. Through the ratchet, the present invention is used conveniently to save labor greatly.

The screw bit holder further comprises a fixing disc. The fixing disc has a central through hole. The fixing disc is fitted on the outside of the fixing shaft through the through hole. The fixing disc has a plurality of fixing troughs around an outer side thereof. The screw bits are secured through the fixing troughs. The outside of the fixing shaft has a plurality of guide grooves. The fixing disc has a plurality of resilient members thereon. The resilient members protrude out of the through hole. The resilient members are buckled on the guide grooves. The fixing disc has a partition to divide each of the fixing trough into two parts. The resilient members are disposed on upper and lower ends of the fixing disc. One end of each resilient member is fixed to the partition, and the other end of each resilient member protrudes out of the through hole.

Figure 14:
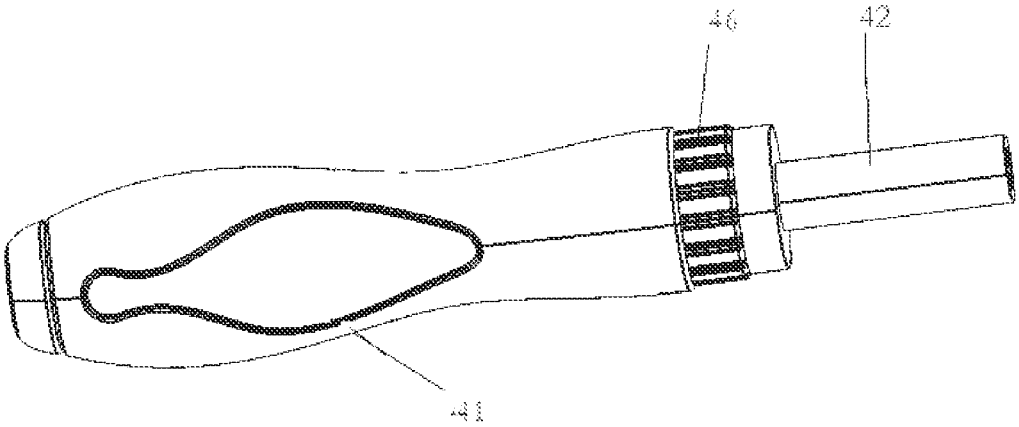
FIG. 14 is a perspective view according to a fourth embodiment of the present invention.
Figure 15:
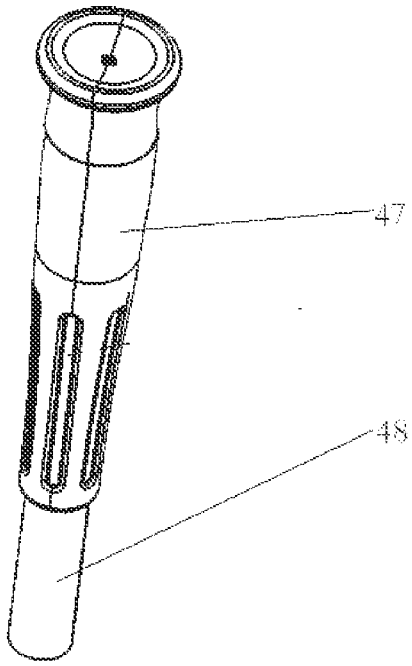
FIG. 15 is a schematic view showing the fixing shaft of FIG. 14.

FIG. 14 and FIG. 15 show a fourth embodiment of the present invention. FIG. 14 is a schematic view showing the screw bit holder according to the fourth embodiment of the present invention. The screw bit holder comprises a handle 41. The handle 41 has a chamber. The handle 41 comprises a first fixing rod 42 fixed at one end thereof for mounting a screw bit. A ratchet 46 is connected between the handle 41 and the first fixing rod 42. A fixing shaft 47 is provided in the chamber of the handle 41. The fixing shaft 47 is adapted to fix a plurality of screw bits. FIG. 15 is a schematic view showing the fixing shaft of FIG. 14. One end of the fixing shaft 47 is connected with a second fixing rod 48 for mounting a screw bit for timepiece. Through the ratchet, the present invention is used conveniently to save labor greatly. The screw bit holder further comprises a fixing disc. The fixing disc has a central through hole. The fixing disc is fitted on the outside of the fixing shaft through the through hole. The fixing disc has a plurality of fixing troughs around an outer side thereof. The screw bits are secured through the fixing troughs. The outside of the fixing shaft has a plurality of guide grooves. The fixing disc has a plurality of resilient members thereon. The resilient members protrude out of the through hole. The resilient members are buckled on the guide grooves.

The fixing disc has a partition to divide each of the fixing trough into two parts. The resilient members are disposed on upper and lower ends of the fixing disc. One end of each resilient member is fixed to the partition, and the other end of each resilient member protrudes out of the through hole.

Although particular embodiments of the present invention have been described in detail for purposes of illustration, various modifications and enhancements may be made without departing from the spirit and scope of the present invention. Accordingly, the present invention is not to be limited except as by the appended claims.

What is claimed is:

1. A screw bit holder, comprising a handle, the handle having a chamber at an upper part thereof, the handle comprising a first fixing rod fixed at a lower end thereof for mounting a screw bit, a fixing shaft provided in the chamber of the handle for fixing a plurality of screw bits, the fixing shaft comprising a second fixing rod at one end thereof, the second fixing rod being adapted to fix a screw bit for timepiece, the screw bit holder further comprising a fixing disc, the fixing disc having a central through hole, the fixing disc being fitted on an outside of the fixing shaft through the through hole, the fixing disc having a plurality of fixing troughs around an outer side thereof, the screw bits being secured through the fixing troughs, wherein an upper end of the handle is movably connected with a base located at an upper end of the chamber to seal the chamber, a lower end surface of the base having a plurality of fixing troughs to accommodate the screw bits, and wherein the base comprises a plurality of engaging members thereon, an upper end of the wall of the chamber being provided with a plurality of protrusions to mate with the engaging members, the engaging members being buckled on the protrusions so that the base is buckled on the wall of the chamber, the base further comprising a plurality of press boards at outer sides of the engaging members, wherein when the press boards are pressed, the press boards are deformable to press the engaging members to disengage from the protrusions, the handle has a notch corresponding in position to the press boards.

2. The screw bit holder as claimed in claim 1, wherein the outside of the fixing shaft has a plurality of guide grooves, the fixing disc having a plurality of resilient members thereon, the resilient members protruding out of the through hole, the resilient members being buckled on the guide grooves.

3. The screw bit holder as claimed in claim 2, wherein the fixing disc has a partition to divide each of the fixing troughs into two parts, the resilient members being disposed on upper and lower ends of the fixing disc, one end of each resilient member being fixed to the partition and another end of each resilient member protruding out of the through hole.

4. The screw bit holder as claimed in claim 1, wherein the handle comprises a plurality of anti-skid protrusions and anti-skid grooves on an outer wall thereof.

5. A screw bit holder, comprising a handle, the handle having a chamber, the handle comprising a first fixing rod fixed at one end thereof for mounting a screw bit, a ratchet connected between the handle and the first fixing rod, a fixing shaft provided in the chamber of the handle for fixing a plurality of screw bits, one end of the fixing shaft being connected with a second fixing rod through the ratchet for mounting a screw bit for timepiece, the screw bit holder further comprising a fixing disc, the fixing disc having a central through hole, the fixing disc being fitted on an outside of the fixing shaft through the through hole, the fixing disc having a plurality of fixing troughs around an outer side thereof, the screw bits being secured through the fixing troughs, wherein an upper end of the handle is movably connected with a base located at an upper end of the chamber to seal the chamber, a lower end surface of the base having a plurality of fixing troughs to accommodate the screw bits, and wherein the base comprises a plurality of engaging members thereon, an upper end of the wall of the chamber being provided with a plurality of protrusions to mate with the engaging members, the engaging members being buckled on the protrusions so that the base is buckled on the wall of the chamber, the base further comprising a plurality of press boards at outer sides of the engaging members, wherein when the press boards are pressed, the press boards are deformable to press the engaging members to disengage from the protrusions, the handle has a notch corresponding in position to the press boards.

6. A screw bit holder, comprising a handle, the handle having a chamber, the handle comprising a first fixing rod fixed at one end thereof for mounting a screw bit, a fixing shaft provided in the chamber of the handle for fixing a plurality of screw bits, one end of the fixing shaft being connected with a second fixing rod through a ratchet for mounting a screw bit for timepiece, the screw bit holder further comprising a fixing disc, the fixing disc having a central through hole, the fixing disc being fitted on an outside of the fixing shaft through the through hole, the fixing disc having a plurality of fixing troughs around an outer side thereof, the screw bits being secured through the fixing troughs, wherein an upper end of the handle is movably connected with a base located at an upper end of the chamber to seal the chamber, a lower end surface of the base having a plurality of fixing troughs to accommodate the screw bits, and wherein the base comprises a plurality of engaging members thereon, an upper end of the wall of the chamber being provided with a plurality of protrusions to mate with the engaging members, the engaging members being buckled on the protrusions so that the base is buckled on the wall of the chamber, the base further comprising a plurality of press boards at outer sides of the engaging members, wherein when the press boards are pressed, the press boards are deformable to press the engaging members to disengage from the protrusions, the handle has a notch corresponding in position to the press boards.

7. A screw bit holder, comprising a handle, the handle having a chamber, the handle comprising a first fixing rod fixed at one end thereof for mounting a screw bit, a ratchet connected between the handle and the first fixing rod, a fixing shaft provided in the chamber of the handle for fixing a plurality of screw bits, one end of the fixing shaft being connected with a second fixing rod for mounting a screw bit for timepiece, the screw bit holder further comprising a fixing disc, the fixing disc having a central through hole, the fixing disc being fitted on an outside of the fixing shaft through the through hole, the fixing disc having a plurality of fixing troughs around an outer side thereof, the screw bits being secured through the fixing troughs, wherein an upper end of the handle is movably connected with a base located at an upper end of the chamber to seal the chamber, a lower end surface of the base having a plurality of fixing troughs to accommodate the screw bits, and wherein the base comprises a plurality of engaging members thereon, an upper end of the wall of the chamber being provided with a plurality of protrusions to mate with the engaging members, the engaging members being buckled on the protrusions so that the base is buckled on the wall of the chamber, the base further comprising a plurality of press boards at outer sides of the engaging members, wherein when the press boards are pressed, the press boards are deformable to press the engaging members to disengage from the protrusions, the handle has a notch corresponding in position to the press boards.

* * * * *